US005264673A

United States Patent [19]

Powell

[11] Patent Number: 5,264,673

[45] Date of Patent: Nov. 23, 1993

[54] CIRCUIT INTERRUPTER WITH CENTER TRIP POSITION AND ALARM

[75] Inventor: William C. Powell, Salisbury, Md.

[73] Assignee: Eaton Corporation, Cleveland, Ohio

[21] Appl. No.: 771,645

[22] Filed: Oct. 3, 1991

[51] Int. Cl.[5] ..... H01H 9/16; H01H 23/00

[52] U.S. Cl. ..... 200/401; 200/308; 200/318; 335/17; 335/21; 335/167

[58] Field of Search ..... 200/400, 401, 308, 318, 200/327, 337; 335/17, 21, 27, 167, 168, 38; 337/79

[56] References Cited

U.S. PATENT DOCUMENTS

| | | | |
|---|---|---|---|
| 2,854,555 | 9/1958 | Edmunds | 200/308 |
| 3,046,371 | 7/1962 | Jencks | 335/21 |
| 3,329,913 | 7/1967 | Camp | 335/38 |
| 3,720,891 | 3/1973 | Nicol | 335/17 X |
| 3,742,403 | 6/1973 | Nicol | 335/17 X |
| 3,863,042 | 1/1975 | Nicol | 200/49 |
| 3,955,162 | 5/1976 | Nicol | 335/17 |
| 3,970,976 | 7/1976 | Nicol | 335/21 |
| 4,093,838 | 6/1978 | Nicol | 200/303 |
| 4,151,386 | 4/1979 | Nicol et al. | 200/303 |
| 4,163,881 | 8/1979 | Borona et al. | 200/401 |
| 4,165,453 | 8/1979 | Hennemann | 200/401 |
| 4,301,342 | 11/1981 | Castonguay et al. | 335/17 X |
| 4,546,224 | 10/1985 | Mastosi | 200/401 |
| 4,616,199 | 10/1986 | Oster | 335/21 X |
| 4,650,944 | 3/1987 | Tedesco et al. | 200/401 |
| 4,760,226 | 7/1988 | Fasano | 200/401 X |
| 5,015,977 | 5/1991 | McKay et al. | 335/17 |
| 5,017,899 | 5/1991 | Critchley | 335/167 X |
| 5,140,115 | 8/1992 | Morris | 200/308 |

*Primary Examiner*—Henry J. Recla
*Assistant Examiner*—Glenn T. Barrett
*Attorney, Agent, or Firm*—L. G. Vande Zande

[57] ABSTRACT

A circuit interrupter manually opens and closes its contacts by use of a manually rotatable handle which acts through a collapsible linkage rotatably connected to a crank extension of the handle and rotatably connected to a rotatably movable contact support. The rotatable contact support is urged away from closed contact position by a main spring and in moving from one contact position to the other the axis of the rotatable connection between the handle crank passes over a center line defined by the center of rotation of the handle and the rotatable connection between the linkage and the movable contact support providing a toggle action to hold the movable contact in selected open or closed position. Upon overload, the mechanism causes collapse of the collapsible linkage allowing the movable contact support to move and open the contacts. A center trip stop member, normally not interfering with the handle, is supported to be moved relative to the mechanism by structure connected to the movable contact arm to a position obstructing the handle switch movement and holding it in center trip position. An auxiliary switch for indicating trip condition may be provided with the circuit interrupter. A spring biased switch operator may be operated by a rotatable actuator pivotally supported on a frame member of the circuit interrupter whereby the collapsing linkage rotates the actuation into engagement with the switch operator of the auxiliary switch, thus actuating the auxiliary switch.

17 Claims, 7 Drawing Sheets

CIRCUIT INTERRUPTER WITH CENTER TRIP POSITION AND ALARM

The present invention relates to a circuit interrupter or circuit breaker which is capable of indicating when the circuit interrupter has been tripped. The trip indication can be seen at the circuit interrupter by the position of the handle which is used to manually open and close the contacts of the circuit interrupter. This handle has a limited range of movement, one end of which represents "on", or closed contact position, and the other end of which represents "off", or open contact position.

In accordance with the present invention, means is provided to cause the handle to assume an intermediate or "center trip position" which is immediately apparent to an observer at the circuit interrupter when the circuit interrupter has been tripped by an overload. The other means provided by the circuit interrupter to indicate that it has been tripped by an overload is a visual and/or audible alarm, which may be local or remote from the circuit interrupter. The alarm is triggered by actuation and closing the contacts of an auxiliary switch when circuit interruption occurs. An actuator arm within the circuit interrupter is moved by elements such as links in a collapsible linkage when collapsed by overload.

In the prior art the center trip indication of open condition of a circuit interrupter following overload has been used. The present invention uses this convention in a specific type of breaker configuration in which the center trip position has previously not been available. Similarly, auxiliary switches have been used in the prior art to indicate various conditions such as an overload trip condition so that the circuit interrupter may be reset. The present invention uses a rotatable actuator movable by collapse of collapsible linkage to actuate the auxiliary switch.

NATURE OF THE PRESENT INVENTION

The present invention provides the center trip position indication for overload actuation for a circuit interrupter which employs a normally rigid toggle linkage which is collapsed (triggered) in closed contact position by means responding to electrical overload to allow the contacts to open. The mechanism is a center trip latching member supported to move relative to the frame positioned so as not to interfere with the handle mechanism during normal operation, but moved as the result of collapse of the linkage during overload to a position obstructing the handle in its movement and holding the handle in the center trip position.

More specifically, the present invention relates to a circuit interrupter which employs the support frame including an insulating casing. A stationary contact is mounted on the insulating casing and a movable contact arm is rotatably supported on the frame to enable a supported movable contact to open and close against the stationary contact. Spring means between the movable arm and the support frame urges the movable contact arm away from closed contact position. A handle for manually opening and closing said contacts is movably supported on the frame and urged to open contact position by a relatively weak spring between the support frame and the handle. A collapsible toggle linkage is rotatably connected at opposite ends to the handle and the movable contact arm, respectively, with each of the rotatable connections being generally parallel to the axis of rotation of the contact arm. When in rigid uncollapsed condition the linkage acts on the contact arm in response to movement of the handle to move the movable contact between open and closed contact conditions. A latch means on the collapsible linkage is capable of being released to permit collapse of the linkage upon an overload condition which, in turn, allows the movable contact to move away from the fixed contact under urging of the spring means while the handle is still in closed contact position. The latch is released on overload by means responsive to overload conditions to collapse the collapsible linkage and allow the contacts to move from closed to open position. A center trip stop member, normally not interfering with the handle mechanism, is supported to be moved relative to the frame by structure connected to the movable contact arm upon collapse of the linkage. The center trip stop member is moved to a position obstructing the handle in its movement as urged by the relatively weak spring means and holding the handle in a center trip position indicating the circuit interrupter has been tripped.

The present invention also relates specifically to a novel actuator for an auxiliary switch supported by the casing. The actuator is a lever rotatably supported on the frame at a point intermediate the ends of the lever. The actuator has a switch operator contact member at one end which is moved into the switch auxiliary operator means to actuate the auxiliary switch when the collapsed linkage rotates the other end of the lever.

More specifically the present invention relates to a circuit interrupter employing a support frame including at least an insulating casing, a stationary contact mounted on the insulating casing and a movable contact arm rotatably supported on the frame to enable a supported movable contact to open and close against the stationary contact. Spring means between the movable arm and the support frame urges the movable contact arm away from the closed contact position. A handle for manually opening and closing said contacts is movably supported on the frame. A collapsible linkage is rotatably connected at opposite ends to the handle and the movable contact arm, respectively, each of said rotatable connections being generally parallel to the axis of rotation of the contact arm. The linkage is comprised of rotatably interconnected links and latch means supported on the connected links to hold the links when latched in rigid condition allowing normal opening and closing of the contacts by movement of the handle between an open and closed position. The latch means is capable of being released to permit collapse of the linkage which, in turn, allows the movable contact to move away from the fixed contact while the handle is still in closed contact position. Means responding to overload conditions is provided for releasing the latch to collapse the collapsible linkage upon predetermined electrical overload to allow the contacts to move from closed to open position. An auxiliary switch is supported on the support frame in position to be actuated by an actuator in the form of a rotatable lever member. The actuator is rotatably supported intermediate its ends upon the support frame, one end of the actuator having means cooperating with the auxiliary switch such that it can be moved into the auxiliary switch operator to actuate it, the other end of the actuator being provided with a surface contacted by the linkage upon collapse of the linkage to rotate the actuator in a direction to actuate the auxiliary switch.

DRAWINGS OF THE PRESENT INVENTION

For a better understanding of the invention reference is made to the accompanying drawings in which.

SPECIFIC DESCRIPTION OF THE PREFERRED EMBODIMENT OF THE PRESENT INVENTION

Figure 1:
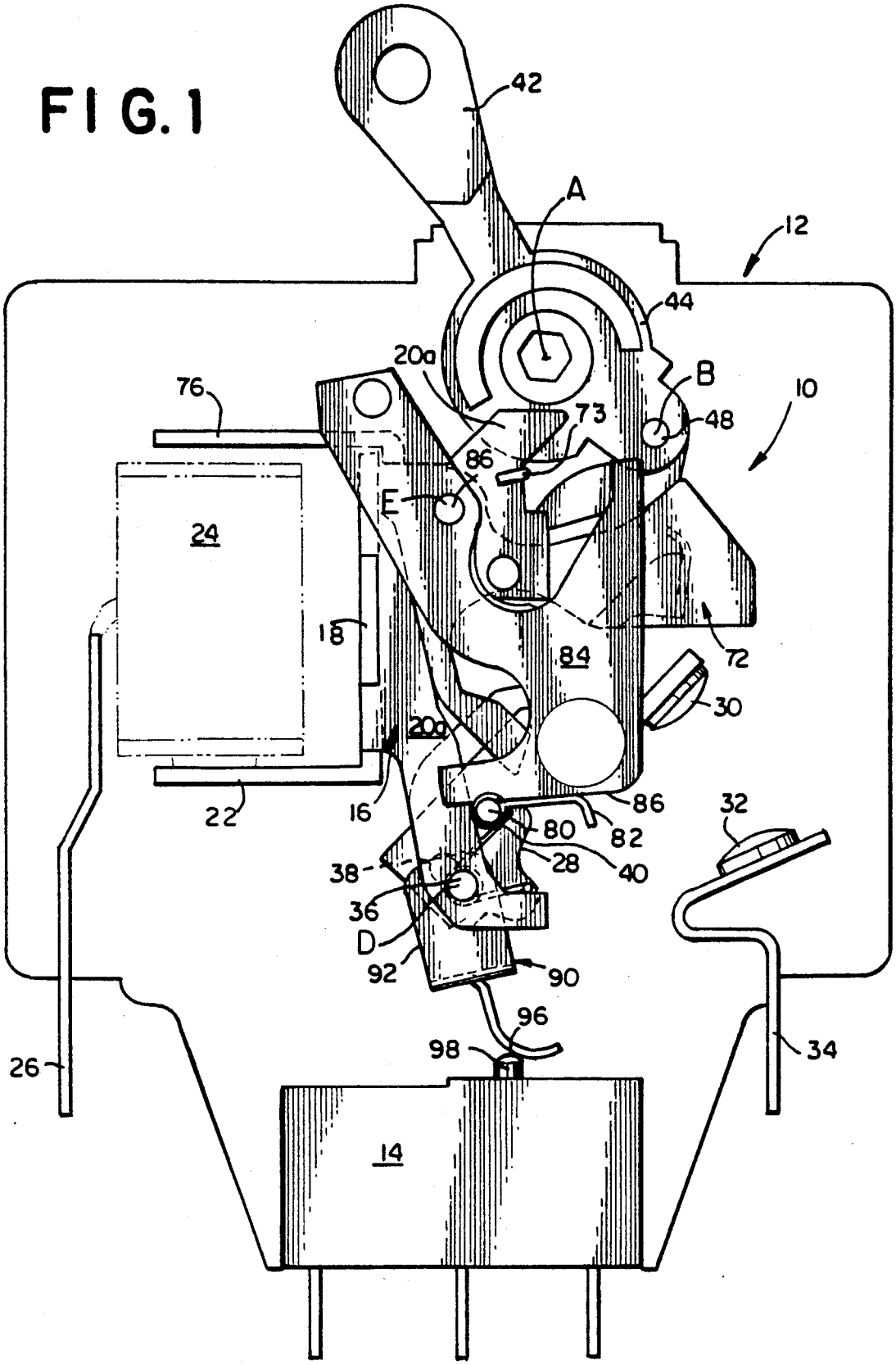
FIG. 1 is an elevational view of a circuit interrupter in accordance with the present invention shown with half of its casing removed so as to effectively show the mechanism of the circuit interrupter including an auxiliary switch in elevation with the contacts in open or "off" position.
Figure 2:
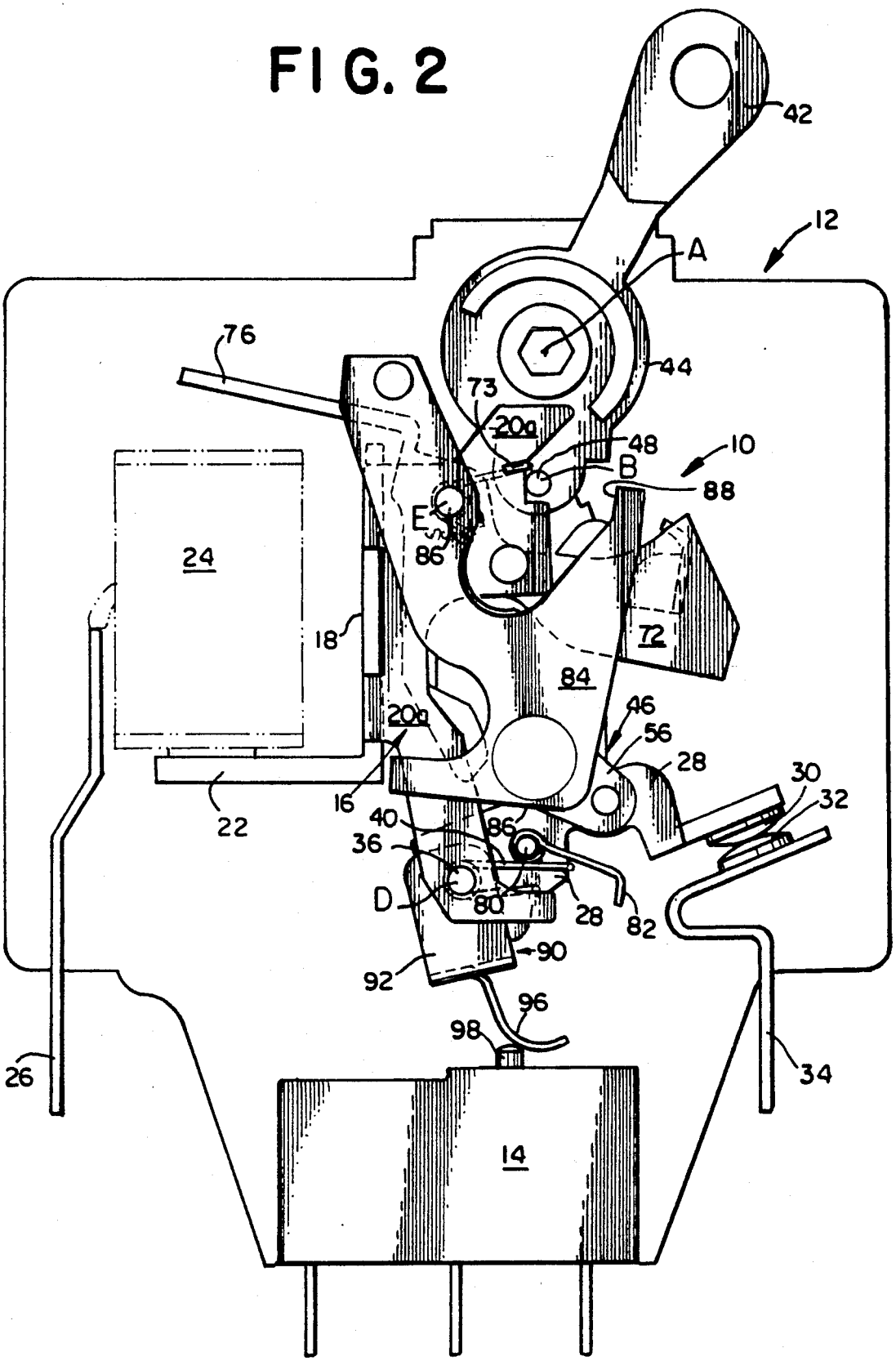
FIG. 2 is a view similar to that of FIG. 1 in which the mechanism is shown with the contacts in closed or "on" position.
Figure 3:
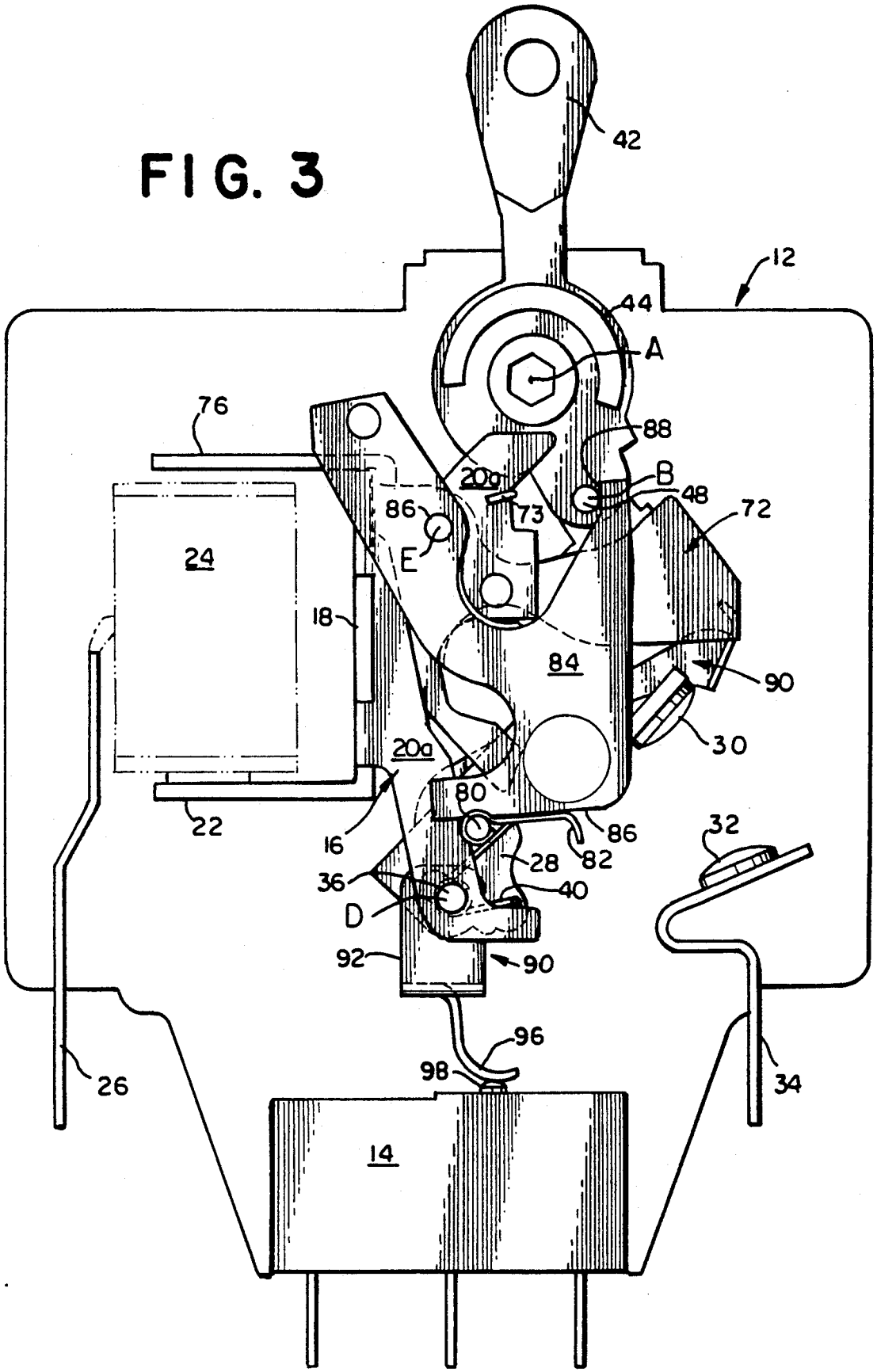
FIG. 3 is a view similar to that of FIGS. 1 and 2 in which the mechanism is shown in center trip position wherein the linkage has collapsed and the actuator has actuated the auxiliary switch.

Referring now to FIGS. 1 to 3 in particular, a circuit interrupter in accordance with the present invention is depicted. As is typical, the circuit interrupter mechanism, generally designated 10, is housed in an insulating casing, generally designated 12, only the outline of which is shown. The casing will be understood to be made of a rigid moldable insulating material such as phenol-formaldehyde and is usually constructed in two mating parts, sometimes referred to as half shells or half casings. The housing is provided with an opening along one of its edges which receives and supports an auxiliary switch 14, which is used to detect when the circuit interrupter switch has been tripped and the contacts remain in the open contact position shown in FIG. 3. The insulating casing 12 serves as part of the support frame for the mechanism 10 partially by providing conforming shapes and forms in the rigid molded casing material. Thus the casing receives and supports other structural members, including the auxiliary switch 14 in this embodiment. The casing provides support molded into the inner walls of the casings for a sheet metal frame member generally designated 16 which in this embodiment includes a common back member 18 from which are folded parallel support arms 20*a* (FIGS. 1-3) and 20*b* (FIG. 8) which provide rotatable support for various pieces of the mechanism. The common back member 18 also supports a bracket 22 which, in turn, supports the electromagnetic winding or coil 24 which produces actuation of the mechanism to open the contacts of the circuit interrupter on overload.

Terminal 26, which is also supported by the casing, is electrically connected to the coil 24. The coil, in turn, is electrically connected through a movable contact arm 28 carrying movable contact 30 to fixed contact 32. When movable contact 30 is closed against fixed contact 32, as seen in FIG. 2, an electrical circuit is complete from electrical terminal 26 through electrical terminal 34 of the circuit interrupter. Electrical terminal 34 mechanically supports the fixed contact 32 and, in turn, is supported by the casing 12.

The movable contact arm 28 is rotatably supported by frame members 20*a* and 20*b* to rotate about a pin 36 which is received in kidney slot 38 (FIGS. 6 and 7) of the movable arm. A main double torsion spring 40 positioned between the frame 16 and movable contact arm 28 in a conventional manner biases the movable arm 28 and its supported contact 30 away from fixed contact 32 and into the open position shown in FIG. 1.

In normal operation the movable contact arm 28 is mechanically actuated manually through handle 42. Handle 42 has a generally cylindrical portion 44 which is received within conforming cylindrical cavities of the mating half-shells of the casing (not shown). The handle 42 extends through an opening in the wall of the casing opposite the wall containing auxiliary switch 14. The handle opening in the casing is a slot sufficiently long to allow the handle 42 to rotate back and forth from the open contact or "off" position shown in FIG. 1 to the closed contact or "on" position shown in FIG. 2.

Figure 6:
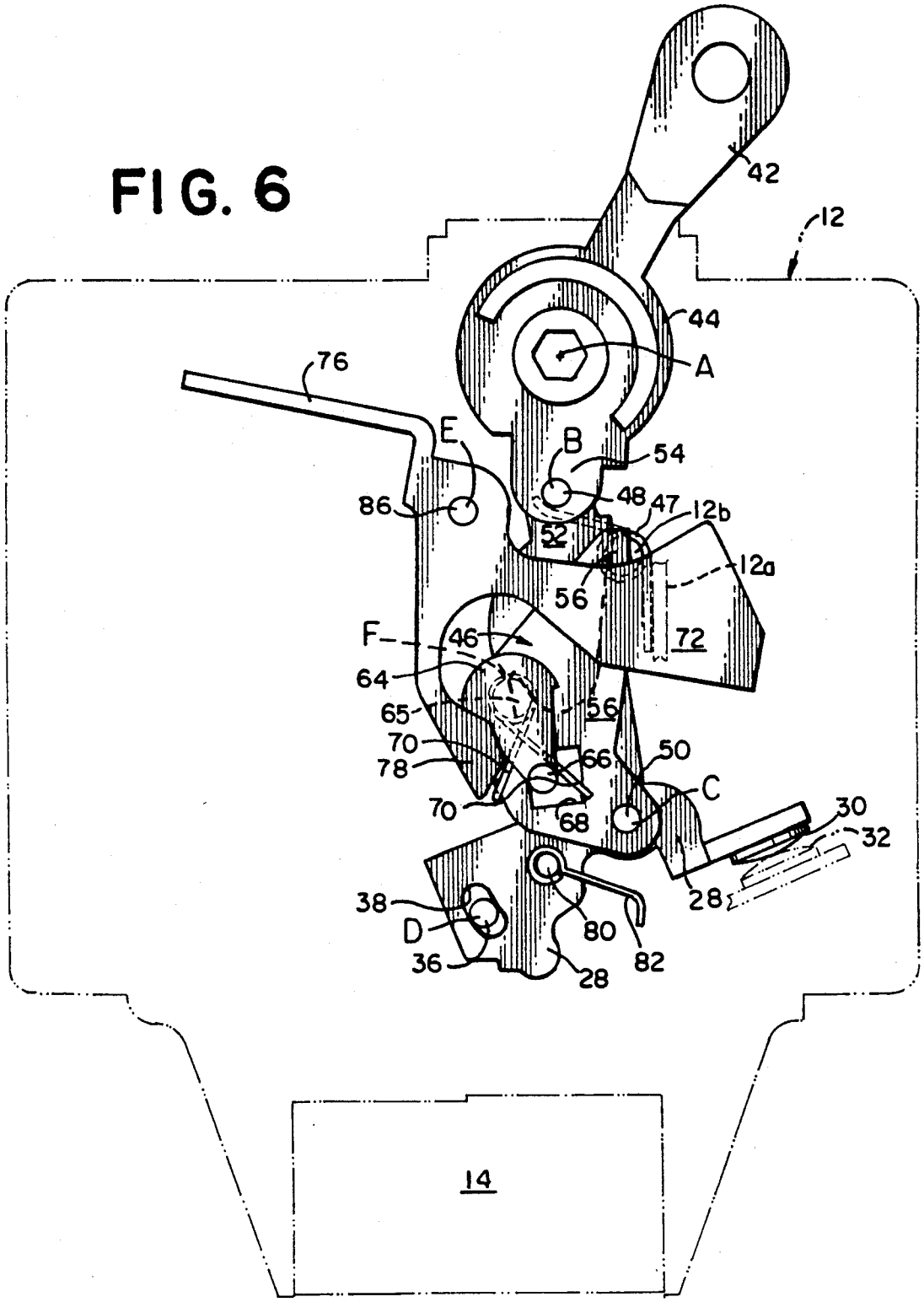
FIG. 6 is a view similar to FIG. 2 with the mechanism in the same position, but with the center trip stop member, the auxiliary switch actuator and the supporting frame removed so that the rest of the mechanism can be seen more clearly.
Figure 7:
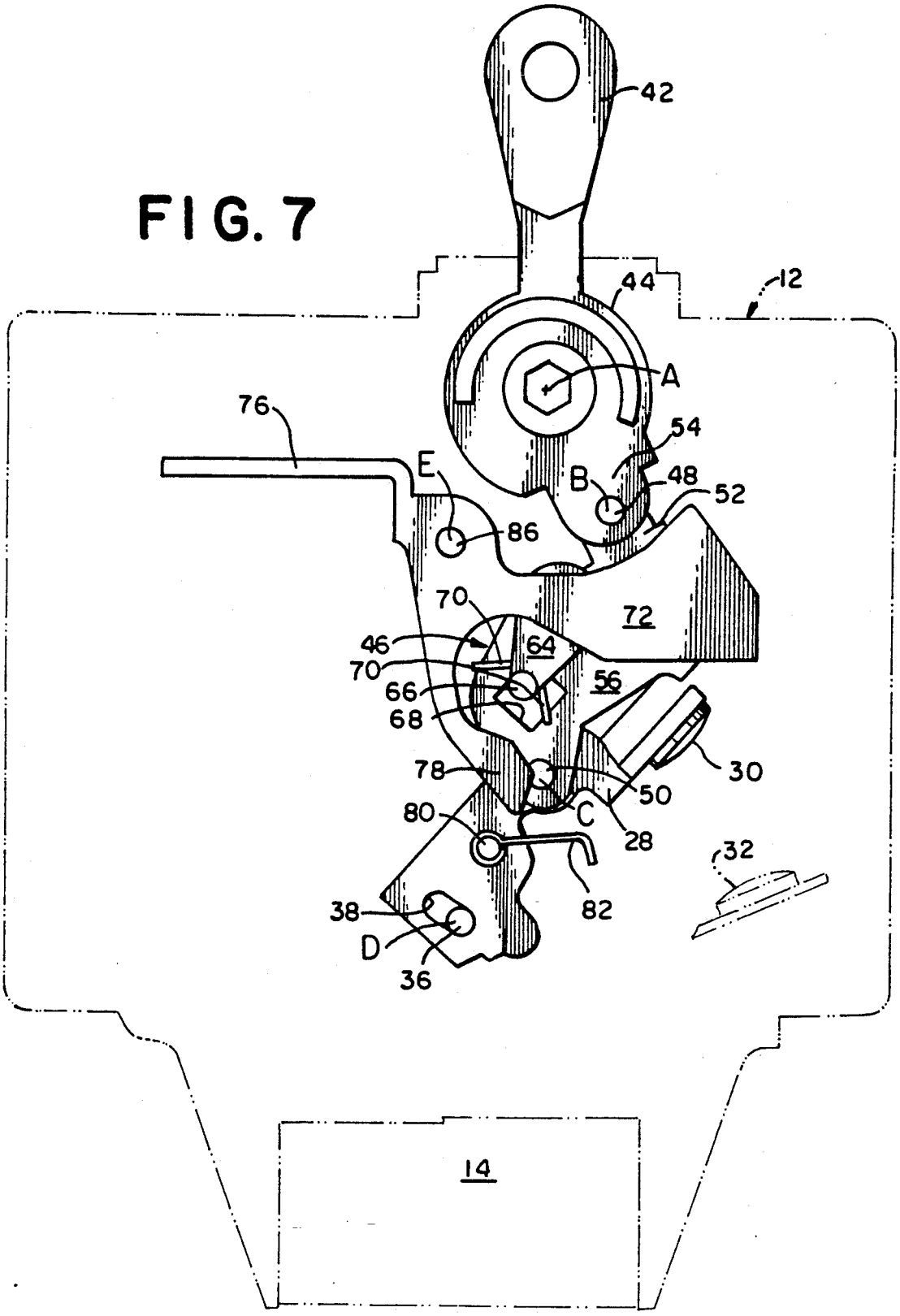
FIG. 7 is a view showing the same structure as shown in FIG. 6, but in the center trip position as also shown in FIG. 3.
Figure 8:
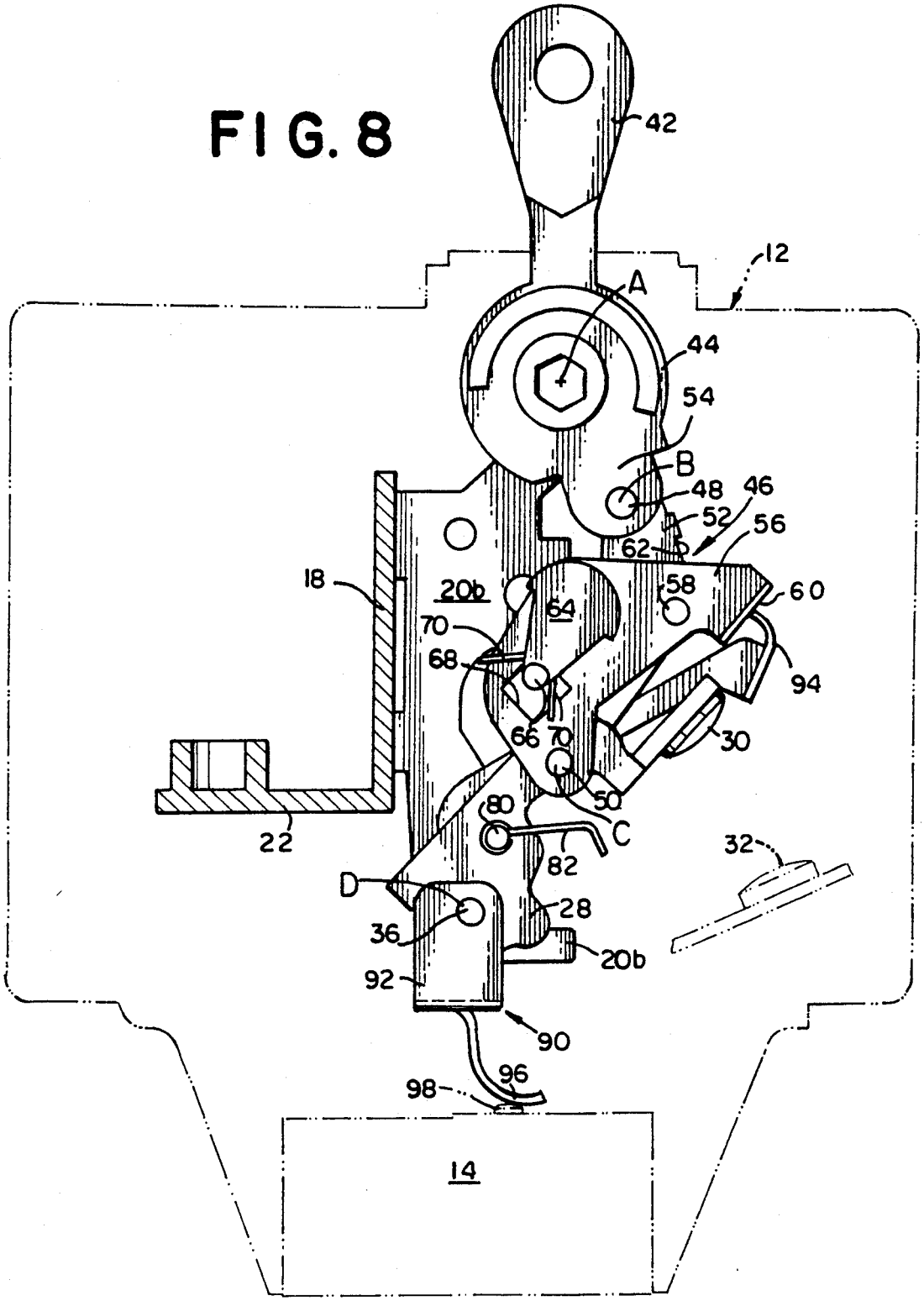
FIG. 8 is a view similar to FIGS. 6 and 7 and with the armature also removed, but with some of the support frame replaced so that the linkage in the auxiliary switch actuator can be seen more clearly.

As best seen in FIG. 6, the handle is connected through a collapsible linkage, generally designated 46, to the movable contact arm 28 by means of pins 48 and 50, respectively, at each end of the collapsible linkage. Pin 48 connects link 52 to crank arm 54 of the handle 42. The crank arm 54 is an integral part of the cylindrical portion 44 of the handle. The cylindrical portion 44 permits rotation of the handle 42 about an axis of rotation A from the off position to the on position. The rotation of the handle about axis A causes pin 48 on crank arm 54 to move from the position shown in FIG. 1 to the position shown in FIG. 2. Pin 50 connects movable contact arm 28 to link 56 of the collapsible linkage 46 as best seen in FIGS. 6 and 7. As shown in FIG. 8, links 52 and 56 are, in turn, interconnected by pin 58. All of the rotation occurring during switching between on and off positions is about parallel axes. More specifically, the handle 42 and its related structure rotates about axis A. Pin 48 provides an axis of rotation B between the crank arm 54 of the handle 42 and link 52 of the collapsible linkage. Pin 50 provides an axis of rotation C between link 56 of the collapsible linkage and the movable contact arm 28. Pin 36 provides an axis of rotation D between the movable contact arm 28 and the frame 16. The latched and rigid linkage 46 provides a toggle action as axis B (pin 48) moves back and forth over a center line defined by axis A and axis C (pin 50) against a spring force supplied by main double torsion spring 40 located between support arms 20*a* and 20*b* with a center portion of the main spring biasing against movable contact support 28 in a conventional manner biasing the armature away from the coil 24.

The collapsible linkage 46 is a variation of a conventional type. U.S. Pat. No. 3,970,976, for example, shows a collapsible linkage of this general type in a mechanism similar in other respects to that illustrated herein. The linkage 46 is held latched in its rigid position shown in FIG. 6. A folded edge 60 of link 56 identified in FIG. 8 engages a latch edge 62 of link 52. The structure is held in the position of FIG. 6 by a lock piece 64 supported on slotted shaft 65 mounted in links 52 and 56. The shaft 65 permits relative rotational movement between the links 52 and 56 when the linkage is collapsed. The lock piece is normally spring biased by lock spring 70 so that pin 66 is held against an edge of opening 68 in link 56 as shown in FIG. 6. When the pin 66 is biased against the edge of the opening 68 by spring 70, a slot in slotted shaft 65 is rotated into a position which prevents relative rotational movement between links 52 and 56 thereby holding the linkage in a latched, rigid position. Upon an overload condition, movement of the armature 72 causes the lock piece 64 to rotate against the bias of the lock spring 70 thereby causing rotation of the shaft 65 so that the flat surface on the slotted shaft 65 rotates to release the lock and allow relative movement and collapse of the links.

Linkage collapse occurs as a result of the action of the armature 72, which is rotatably supported to the frame 20*a*, 20*b* by pin 86 to rotate about an axis E parallel to the others. An armature spring 73, in the form of a torsion spring, is carried on pin 86. One leg of the spring 73 is connected to frame member 20*a*. The other end of the spring 73 is connected to a sprocket on the armature biasing the armature away from the coil 24. The spring 73 functions to bias the armature so that clapper 76 of the armature is rotated away from the coil 24. When the clapper 76 is urged away from the coil 24 by the armature spring 73, a tail piece 78 (FIGS. 6 and 7) is rotated away from pin 66 of the lock to prevent unlatching of the linkage. As overload occurs, rotation of the armature 72 occurs from the position of FIG. 6 to the position of FIG. 7 as the clapper 76 is attracted to the core of coil 24 as shown in FIG. 3. As this occurs, because of the rotation of the armature 72 about pin 86 (axis E), the armature tail piece 78 hits the pin 66 of the lock 64 causing rotation of the slotted shaft 65 about an axis F against the bias of spring 70 so that the slotted shaft 65 releases links 52 and 56 to collapse about pin 58 as seen in FIG. 8.

Figure 4:
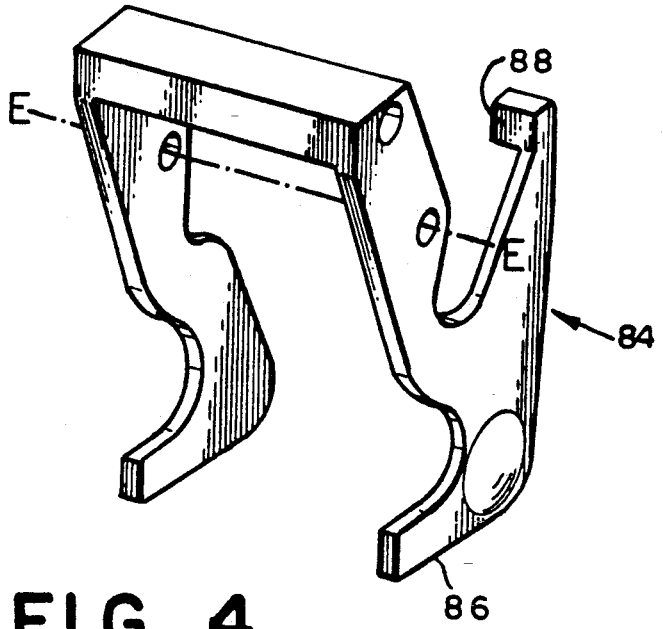
FIG. 4 is a perspective view of a center trip stop member in accordance with the present invention.

The movable contact arm 28 also supports flag post 80 which carries in fixed position a sheet metal cam member 82. Cam member 82 is designed to cooperate with a center trip stop member 84, a perspective view of which is seen in FIG. 4. Stop member 84 is rotation E. Pin 86 is supported on support flanges 20*a* and 20*b* of the support frame 16. In normal operation, when the circuit interrupter is switched from the on position to the off position, cam 82 engages surface 86 of the rotatable stop member 84 causing the stop member to rotate and engage clapper 76 of the armature thereby causing the armature to rotate in a direction in which the clapper 76 moves toward coil 24. The tail piece 78 also rotates toward pin 66 of the lock but does not engage or unlatch the linkage. During a trip condition, cam 82 acts upon surface 86 of the rotatable stop member 84 causing the center trip stop member 84 to rotate from the position of FIG. 2 to the position of FIG. 3 so that stop surface 88 of the stop member 84 is interposed and stops the movement of pin 48 thereby stopping movement of the handle 42 in the center trip position shown in FIG. 3.

A handle spring 47 is mounted on a boss 12*b* of a half-shell of the casing as shown in FIG. 6. The handle spring 47 is in the form of a torsion spring having one end biased against a shoulder 12*a* molded into the half-shell of the casing. The other end of the handle spring 47 biases against pin 48 carried in the crank arm 54 of the handle 42. The handle spring 47 biases against the crank arm 54 causing the handle 42 to rotate toward its off position as shown in FIG. 1. When the movement of the handle 42 is stopped by the stop member 84 under a trip condition, the relatively weak handle spring 47 functions to rotate the handle 42 from the on position to the mid-trip position and thereafter functions to hold the handle 42 in the center trip position.

The purpose of stopping the handle in the center trip position under a trip condition is to allow responsible persons at the location of the circuit interrupter to see that the circuit interrupter has been tripped and to allow those persons to reset the collapsed linkage to a rigid condition if desired by moving the handle 42 from the center trip position to the off position shown in FIG. 1. In order to reset the collapsed linkage to its rigid condition, surface 60 (FIG. 8) on link 56 is moved back against the stop surface 62 (FIG. 8) on link 52. The slotted shaft 65 (FIG. 6) uses the spring force of lock spring 70 to rotate about axis F (FIG. 6) in a direction toward tail piece 78 until links 52 and 56 relatch in rigid condition. In repositioning handle 42 from the center trip position of FIG. 3, the stop 88 on the center trip stop member 84 is overridden by pin 48 on the crank member 54 of the handle 42. This override is effected because of the flexibility of the stop member 84 and the give of the main spring bias. The give in the main spring 40 is effected because the stop member 84 yields back through the cam 82 to the moveable contact arm 28 and its main spring 40.

Figure 5:
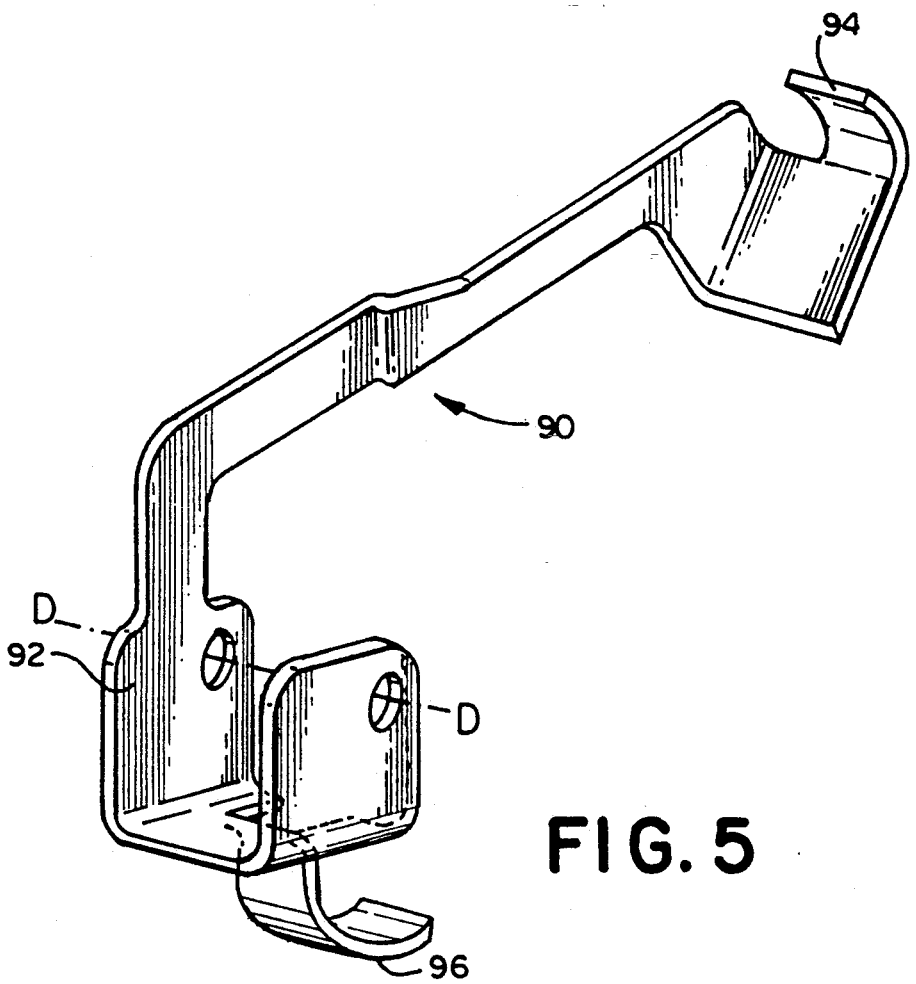
FIG. 5 is a perspective view of an auxiliary switch actuator in accordance with the present invention.

When a trip condition occurs and the mechanism goes from the on or closed position of FIG. 2 to the center trip position of FIG. 3, an auxiliary switch actuator 90 shown best in FIGS. 5 and 8 is also moved. As seen in FIGS. 1 and 2, the actuator 90 is rotatably supported on pin 36 by support piece 92 to permit the actuator 90 to rotate about axis D. Upon tripping the breaker, the link 56 through surface 60 contacts the actuator drive extension 94 of the switch actuator 90, as shown in FIG. 8, to cause the actuator 90 to rotate about pin 36. This rotation of the actuator 90 causes the switch plunger contact 96 of the actuator 90 to move into engagement with the plunger 98 of the auxiliary switch 14 thereby depressing the plunger 98 against its own internal spring as shown in FIGS. 3 and 8. Depression of the plunger 98 causes the auxiliary switch contacts to close thereby causing the auxiliary switch circuit to be energized. The auxiliary switch circuit may be used to remotely indicate the tripped condition of a specific circuit interrupter by, for example, illuminating a light or sounding a buzzer, or any combination of things.

When the handle 42 of the switch is moved from the center trip position to the off position thereby resetting the collapsible linkage, the link 56 and surface 60 thereof are moved out of the way of drive extension member 94 so that the spring force of the plunger 98 of the auxiliary switch 14 urges the plunger 98 out of its depressed position. Movement of the plunger 98 from its depressed position causes the actuator 90 to rotate about pin 36 back into a rest position. Remote indication of the open circuit by the auxiliary switch is then terminated, as the associated auxiliary switch opens.

The device of the present invention has been described in terms of a preferred embodiment. Those skilled in the art will understand that many modifications and variations of the structure are possible. All such variations and modifications within the scope of the claims are intended to be within the scope and spirit of the present invention.

I claim:

1. A circuit interrupter comprising:

a support frame including an insulating casing;

a stationary contact mounted on the insulating casing;

a movable contact arm rotatably supported on the frame to rotate about an axis of rotation to open and close a supported movable contact against the stationary contact;

main spring means between the movable contact arm and the support frame urging the movable contact arm away from the closed contact position;

a handle movably supported on the frame for manually opening and closing said contacts;

a collapsible linkage having opposite ends rotatably connected to the handle and to the movable contact arm, respectively, by connection means having axes generally parallel to the axis of rotation of the movable contact arm, the collapsible linkage in a rigid uncollapsed condition acting as a toggle on the movable contact arm in response to movement of the handle to move the movable contact between open and closed contact positions and to hold the movable contact in the position selected by such handle movement;

latch means mounted on the linkage operable to latch the linkage in the rigid uncollapsed condition and releasable to permit collapse of the linkage which, in turn, allows the movable contact to move away from the stationary contact while the handle is still in closed contact position;

means responsive to overload conditions for releasing the latch means to collapse the collapsible linkage upon predetermined electrical overload to allow the movable contact to move from a closed to open position; and a center trip stop member mounted to the frame for movement relative thereto, the center trip stop member having no engagement with the collapsible linkage; and means on the movable contact arm abutting the center trip stop member upon movement of the movable contact arm to the open contact position in response to collapse of the linkage, the movable contact arm means driving the center trip stop member to a position obstructing handle movement and holding the handle in a center trip position indicating that the circuit interrupter has been tripped.

2. The circuit interrupter of claim 1 in which said collapsible linkage comprises links interconnected with a rotatable connection having an axis of rotation parallel to that of the movable contact arm, said links remaining in rigid uncollapsed condition throughout normal opening and closing of the contacts by movement of the handle between an open and closed position.

3. The circuit interrupter of claim 2 in which said latch means is capable of being reset to latch the links of the collapsible linkage in rigid condition by moving the handle from center trip position to open position.

4. The circuit interrupter of claim 2 in which a relatively weak spring between the support frame and the handle urges the handle into its center trip position and holds the handle therein against the center trip stop member.

5. The circuit interrupter of claim 1 in which the handle is rotatably supported on the frame to rotate about an axis parallel to the axes of rotation of the linkage connections and has a crank arm portion to which its rotatable connection to the collapsible linkage is made positioned such that that rotatable connection to the collapsible linkage passes back and forth over a line between the axis of handle rotation and the axis of the rotatable connection of the collapsible linkage to the movable contact arm whereby the main spring means provides the bias required for a toggle action keeping the contact open when the handle is in open contact position and closed when the handle is in closed contact position.

6. The circuit interrupter of claim 5 in which said means on the movable contact arm driving the center trip stop member into position obstructing the handle is a cam member fixed to and movable with the movable contact arm, which cam member moves into abutting engagement with a surface of the center trip stop member to move the center trip stop member into position obstructing the handle.

7. The circuit interrupter of claim 6 in which the center trip stop member interrupts the handle by interposing a stop shoulder in the path of a lateral extension of the handle.

8. The circuit interrupter of claim 7 in which the lateral extension of the handle is a pin rotatably coupling the handle to the collapsible linkage, the pin being supported on the crank arm portion of the handle.

9. The circuit interrupter of claim 1 in which a normally open auxiliary switch having a spring biased switch operator is supported by the casing and an auxiliary switch actuator cooperates with the switch operator to operate the auxiliary switch, the auxiliary switch actuator being pivotally supported by the frame in position to be engaged only by the linkage upon collapse of the linkage to be rotated by the linkage into the switch operator to close the auxiliary switch when the circuit interrupter has been tripped.

10. A circuit interrupter comprising:

a support frame including an insulating casing;

a stationary contact mounted on the insulating casing;

a movable contact arm rotatably supported on the frame to rotate about an axis of rotation to open and close a supported movable contact against the stationary contact;

main spring means between the movable contact arm and the support frame urging the movable contact arm away from the closed contact position;

a handle for manually opening and closing said contacts movably supported on the frame;

a collapsible linkage having opposite ends connected by rotatable connection means to the handle and to the movable contact arm, respectively, each of said rotatable connection means being generally parallel to the axis of rotation of the movable contact arm, said linkage comprising rotatably interconnected links and latch means to hold the links, when latched, in rigid condition allowing normal opening and closing of the contacts by movement of the handle between an open and closed position; said latch means being capable of being released to permit collapse of the linkage which, in turn, allows the movable contact to move away from the stationary contact while the handle is still in closed contact position;

means responsive to overload conditions for releasing the latch means to collapse the collapsible linkage upon predetermined electrical overload to allow the contacts to move from closed to open position;

an auxiliary switch supported by the casing having a spring biased switch operator; and an auxiliary switch actuator separate from the handle, cooperative with the switch operator and pivotally supported by the frame in position to be engaged only by the linkage upon collapse of the linkage to be rotated by the linkage into the switch operator to close the auxiliary switch and be held in that position until the handle is moved to relatch the linkage.

11. The circuit interrupter of claim 10 in which the auxiliary switch actuator is pivotally supported between respective ends of the auxiliary switch actuator, one end of which is moved by the linkage upon collapse and the other end of which is thereby moved into the auxiliary switch operator.

12. The circuit interrupter of claim 11 in which the pivotal support of the actuator is placed closer to the end of the auxiliary switch actuator contacting the auxiliary switch operator.

13. In a circuit interrupter having at least a movable contact arm rotatably supported on a frame to enable a supported movable contact to open and close against a stationary contact, a handle movably supported on the frame, collapsible linkage interconnecting the handle and the movable contact arm and in uncollapsed condition permitting the handle to manually open and close the contacts, and means responsive to overload conditions for releasing the collapsible linkage upon a predetermined electrical overload to allow the contacts to move from closed to open position, an improvement comprising:

a center trip stop member, normally not contacting the handle mechanism, the collapsible linkage or the movable contact arm, supported by the frame to be moved by movement of the movable contact arm upon collapse of the linkage to a position obstructing handle movement such that the handle moving against the stop member will be in a center trip position visually indicating that the circuit interrupter has been tripped.

14. The circuit interrupter of claim 13 in which the center trip stop member is rotatably supported on the frame, the rotatably supported moveable contact arm is spring biased to move away from closed contact position and is provided with a cam surface cooperating with the center trip stop member to urge the center trip stop member into its handle obstructing position upon collapse of the collapsible linkage.

15. The circuit interrupter of claim 14 in which the handle when obstructed may be moved to override the center trip stop member which causes the center trip stop member to field thereby causing the resiliently urged moveable contact arm to yield permitting the handle to be moved to its off position.

16. The circuit interrupter of claim 15 in which the moveable contact arm includes a cam surface for contacting and moving the center trip stop member, the cam surface being positioned to contact the center trip stop member and being supported on the contact arm by a fixed post.

17. In a circuit interrupter having at least a movable contact arm rotatably supported on a frame to enable a supported movable contact to open and close against a stationary contact, a handle movably supported on the frame, collapsible linkage interconnecting the handle and the movable contact arm and in uncollapsed condition permitting the handle to manually open and close the contacts, means responsive to overload conditions for releasing the collapsible linkage upon a predetermined electrical overload to collapse the linkage and allow the contacts to move from closed to open position, and an auxiliary switch supported on the frame, the auxiliary switch having a switch operator spring biased to an extended position, an improvement comprising:

an auxiliary switch actuator separate from the handle, cooperative with the switch operator and pivotally supported by the frame in position to be engaged only by the linkage upon collapse of the linkage to be rotated by the linkage into the switch operator to close the auxiliary switch and be held in that position until the handle is moved to relatch the linkage.

* * * * *